US005201288A

United States Patent [19]

Döragrip

[11] Patent Number: 5,201,288

[45] Date of Patent: Apr. 13, 1993

[54] TWO-CYCLE ENGINE WITH FUEL INJECTION

[75] Inventor: Fridolf A. G. Döragrip, Backsvalevägen, Sweden

[73] Assignee: Aktiebolaget Electrolux, Stockholm, Sweden

[21] Appl. No.: 865,906

[22] Filed: Apr. 9, 1992

[30] Foreign Application Priority Data

May 24, 1991 [SE] Sweden ..... 9101583-4

[51] Int. Cl.[5] ..... F02B 33/04

[52] U.S. Cl. ..... 123/73 DA; 123/73 A

[58] Field of Search ..... 123/73 DA, 73 PP, 73 V, 123/73 A, 65 R, 74 A

[56] References Cited

U.S. PATENT DOCUMENTS

| | | | |
|---|---|---|---|
| 2,531,699 | 11/1950 | Phelps | 123/73 DA |
| 2,565,972 | 8/1951 | Kos | 123/73 DA |
| 2,610,616 | 9/1952 | Woodruff et al. | 123/73 DA |
| 2,946,324 | 7/1960 | Casini | 123/73 DA |
| 3,134,373 | 5/1964 | Schauer | 123/73 DA |
| 3,753,425 | 8/1973 | Hooper | 123/73 DA |

FOREIGN PATENT DOCUMENTS

| | | | |
|---|---|---|---|
| 295727 | 4/1932 | Italy | 123/73 DA |

*Primary Examiner*—David A. Okonsky

*Attorney, Agent, or Firm*—Pearne, Gordon, McCoy & Granger

[57] ABSTRACT

In a two-cycle engine provided with crankshaft controlled fuel injection, fuel is supplied from a fuel tank to an inlet (23) having an adjusting means. The fuel flows via a connection (27) to a passage (39) in the crankshaft (13). Gaskets and O-rings are provided to seal off against the crankshaft and crankcase. The positions of the connection (27) and the crankshaft passage (39) are selected so as to obtain communication when underpressure prevails in the crankcase whereby fuel is sucked in and thrown out by centrifugal force via a nozzle (31).

4 Claims, 2 Drawing Sheets

TWO-CYCLE ENGINE WITH FUEL INJECTION

The present invention relates to a two-cycle engine in which fuel is injected via the crankcase which during a motor revolution is exposed in intervals to under and overpressure, respectively, by the movements of the piston.

Small combustion engines require simple, efficient systems for fuel injection unlike large car engines in which the aspects of space and cost are less important. Small engines e. g. for portable tools operate at a relatively high rate of pollution due to unclean exhaust gases, and this state of things can be improved by controlling the air-fuel mixture supplied to the engine. More or less complicated fuel injection devices have therefore been used, but the issue of adjustment between cost, space and efficiency is still an unsolved problem. The present invention is intended to be a step on the way toward an optimal solution.

The problem forming the basis of the invention thus consists in finding a single solution comprising injection nozzle, on/off valve, fuel amount meter and fuel pump in order to provide all the functions of the injection. In the present device the vacuum interval of the crankcase is used for pumping and mixing air/fuel, and the pressure interval as usual provides the transfer of the combustion gas to the combustion chamber. The device with its passage system is provided in the crankshaft the rotation of which determines the point of time for the injection of the fuel. The characteristic features of the invention are set forth in the characterizing clause of claim 1.

Figure 1:
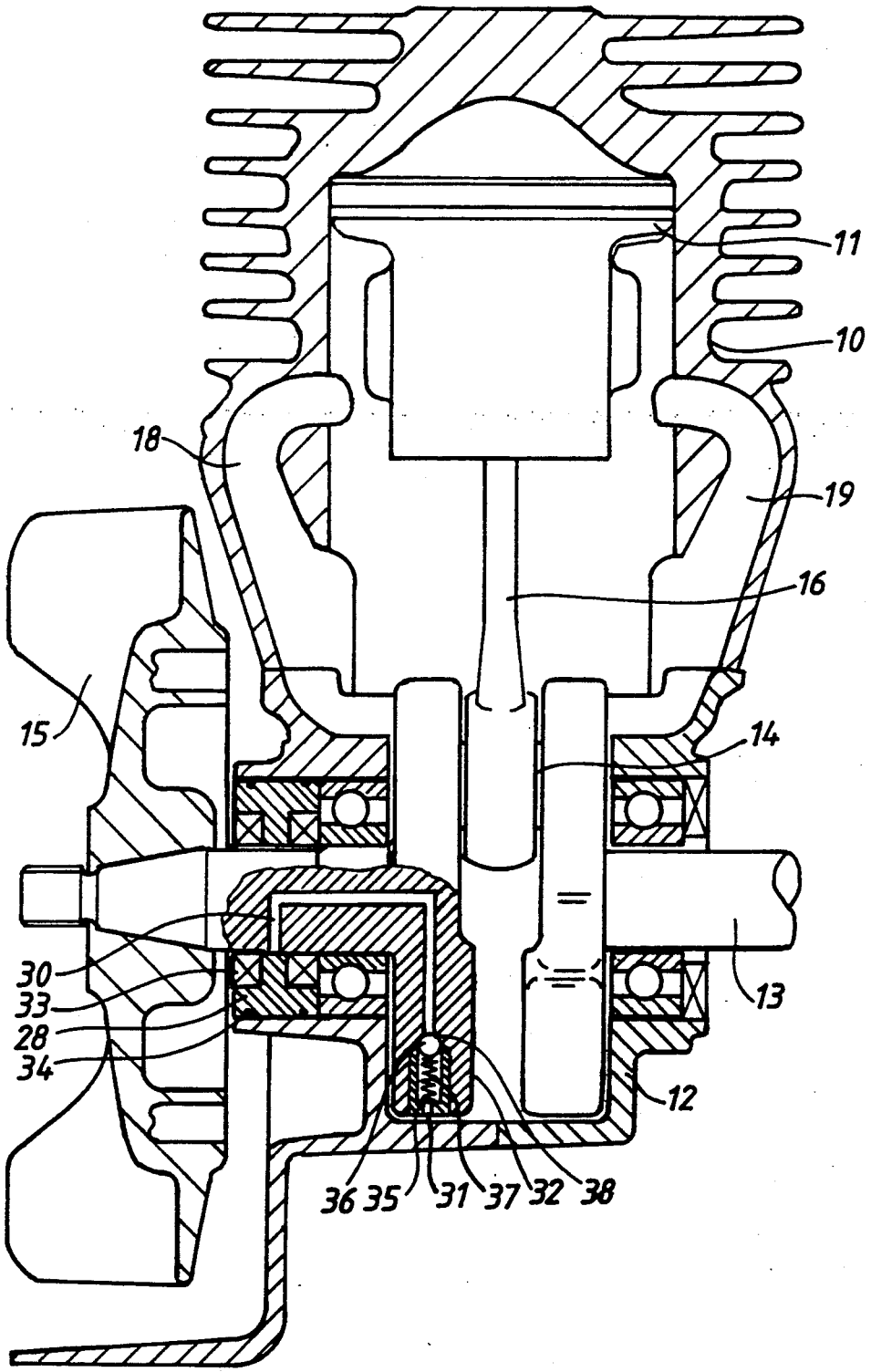
Figure 2:
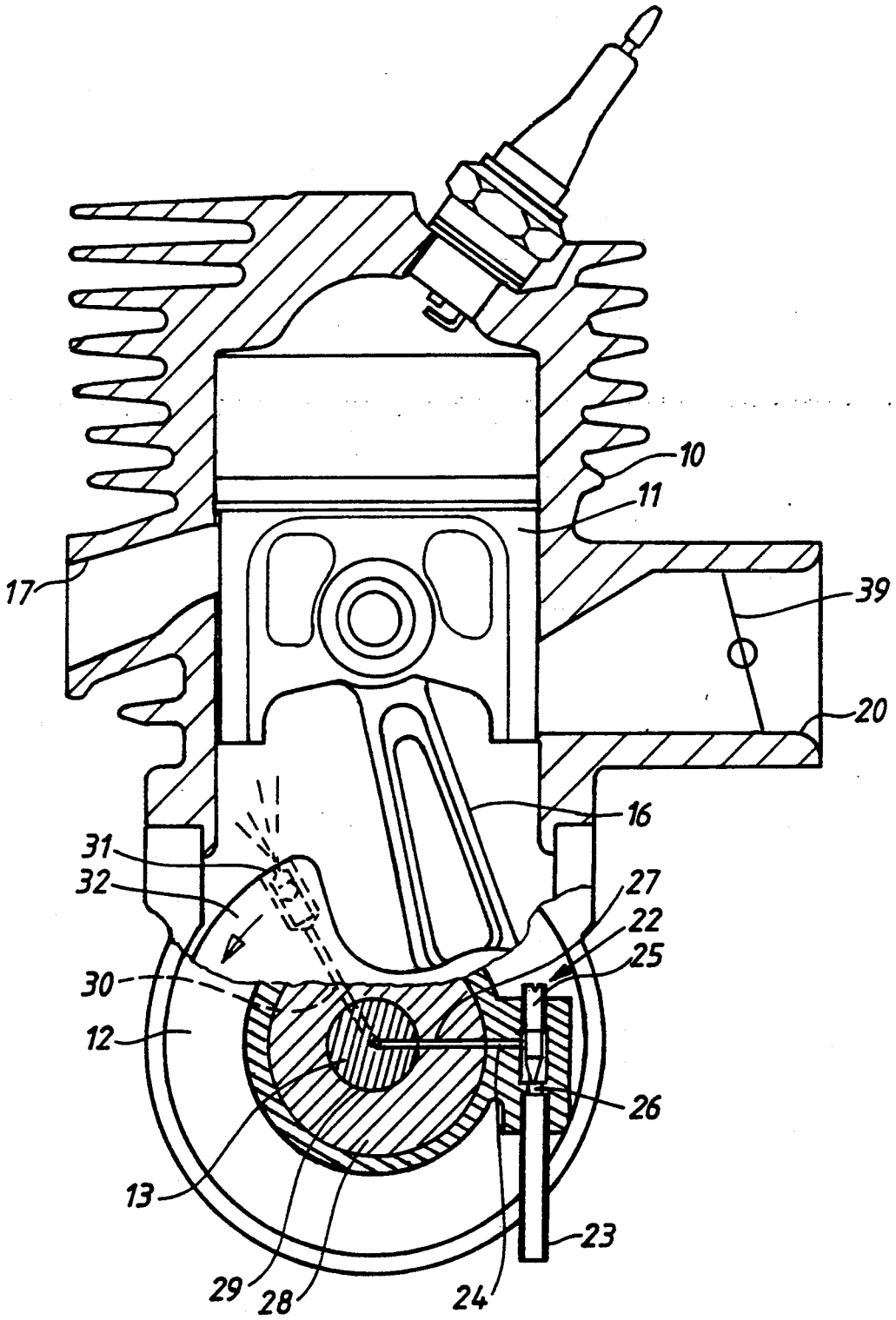

An embodiment of the device according to the invention will be described in the following with reference to the accompanying drawings, in which FIG. 1 is a vertical section of an engine provided with the device according to the invention, and FIG. 2 is a section taken perpendicular to the crankshaft of the engine in FIG. 1.

The illustrated engine comprises only the main portions of a two-cycle engine such as cylinder 10, piston 11, crankcase 12, crankshaft 13 with its crank 14, flywheel 15, and piston rod 16. The cylinder wall has an exhaust gas passage 17 and overflow passages 18, 19, the muzzles of which are above the piston when it is in its lower turning position. An inlet passage 20 is situated diametrically opposite to the exhaust passage and is opened to the crankcase when the piston is in its upper turning position.

The portion of the engine constituting the device for fuel injection is situated in the end of the crankshaft facing the flywheel. Fuel from a tank flows to an ajustment valve 22 having an inlet 23 and an outlet 24. The fuel flows via an adjustment screw 25 and a valve seat 26 to a passage 27 opening into an intermediate member 28 in the form of a short cylinder having a bore 29 surrounding the crankshaft. Passages 30 are provided in the crankshaft from a connection to passage 27 to a nozzle 31 in a balance weight 32. Gaskets 33 and 0-rings 34 seal off against the crankcase in order to obtain a passage free of leakage. The muzzle in the intermediate portion and the passage in the crankshaft are oriented such as to obtain interconnection when the piston is on its way upward in the cylinder and underpressure prevails in the crankcase (FIG. 2). Fuel is then sucked through the passage and is thrown out by centrifugal force through the nozzle 31 during operation. During the further upward movement of the piston the inlet 20 is opened and combustion air is sucked into the crankcase and mixed with the fuel.

The end of the passage 30 is provided with a stop valve 35 having a ball 36 and a spring 37 pressing the ball toward a seat 38. During operation, the ball is separated from the seat by centrifugal force but in non-operative position seals against the seat in order to prevent fuel leakage from the passage. When the engine is started, e. g. by a rope starter, fuel is not provided via valve 35, and instead a manual pump means, e. g. a primer, must be used. During normal operation the speed of rotation is controlled by means of an air valve 39 in inlet passage 20. The fuel mixture is controlled by adjustment screw 25 by means of which the amount of fuel provided to the outlet 24 can be adjusted.

The described arrangement is an example of an embodiment of the invention. The passages in the crankshaft, crankcase and intermediate portion can have varying positions and combinations depending on the caracter of the engine. Such modifications are also inherent in the scope of the invention as defined in the accompanying claims.

I claim:

1. A two-cycle engine with a crankshaft, fuel injection, crankcase flushing of combustion gas and an adjustable, piston-controlled air inlet in the cylinder wall, characterized by a passage system for supplying fuel form an inlet (23) via a first passage (27) in an intermediate member between the inlet and the crankshaft (28) and a second passage (30) to a nozzle (31) provided in a counterweight (32) of the crankshaft, said first passage (27) and said second passage (30) being interconnected in an interval of the revolution of the crankshaft in which underpressure prevails in the crankcase, and said nozzle having a ball valve which closes the nozzle in a non-operative position and opens the nozzle during rotation of the crankshaft due to centrifugal force.

2. A two-cycle engine according to claim 1, characterized in that the intermediate member has the form of a ring (28) surrounding the crankshaft, and said first passage (27) comprises a radial passage which in said interval communicates with said second passage (30) and said nozzle (31).

3. A two-cycle engine according to claim 2, characterized in that said first passage (27) and said fuel inlet (23) communicate via an adjustment valve (22) having an adjustment screw (25) for determining the flow through the valve.

4. A two-cycle engine according to claim 2, characterized in that the ring (28) is situated axially outside a crankshaft bearing in a socket in the crankcase having sealings against the ring in the form of O-rings (34).

* * * * *

UNITED STATES PATENT AND TRADEMARK OFFICE

CERTIFICATE OF CORRECTION

PATENT NO. : 5,201,288

DATED : April 13, 1993

INVENTOR(S) : Fridolf A. G. Doragrip

It is certified that error appears in the above-identified patent and that said Letters Patent is hereby corrected as shown below:

Column 2, Claim 1, line 5, delete "form" and insert --from--.

Signed and Sealed this

Fifth Day of April, 1994

Bruce Lehman

*Attest:*

BRUCE LEHMAN

*Attesting Officer*

*Commissioner of Patents and Trademarks*